US008250899B2

(12) United States Patent
Janversan

(10) Patent No.: US 8,250,899 B2
(45) Date of Patent: Aug. 28, 2012

(54) DENT REMOVAL TOOL

(75) Inventor: Hamid Janversan, Salt Lake City, UT (US)

(73) Assignee: H&S Autoshot Manufacturing Company Ltd., Georgetown (CA)

( * ) Notice: Subject to any disclaimer, the term of this patent is extended or adjusted under 35 U.S.C. 154(b) by 205 days.

(21) Appl. No.: 12/816,950

(22) Filed: Jun. 16, 2010

(65) Prior Publication Data

US 2010/0294017 A1 Nov. 25, 2010

Related U.S. Application Data

(63) Continuation-in-part of application No. 12/642,001, filed on Dec. 18, 2009, now Pat. No. 7,958,767.

(60) Provisional application No. 61/180,844, filed on May 23, 2009.

(51) Int. Cl.
*B21D 1/12* (2006.01)
*B21J 13/08* (2006.01)

(52) U.S. Cl. ..... 72/459; 72/325; 72/372; 72/458; 72/479; 72/705

(58) Field of Classification Search ..... 72/309, 72/325, 372, 457, 458, 459, 465.1, 466.6, 72/479, 480, 705
See application file for complete search history.

(56) References Cited

U.S. PATENT DOCUMENTS 1,737,084 A 11/1929 Hilstad
2,191,720 A 2/1940 Meinhardt
2,749,795 A 6/1956 Boykin, Jr.
2,776,587 A 1/1957 Killius
2,852,971 A 9/1958 MacAluso, Jr.
2,922,326 A 1/1960 Martin
2,957,376 A 10/1960 Parisi
3,091,983 A 6/1963 Kliss
3,359,778 A 12/1967 Di Maio
3,712,106 A 1/1973 Holsapple et al.
4,026,139 A 5/1977 Glaser et al.
4,037,448 A 7/1977 Di Maio et al.
4,072,042 A 2/1978 Servin et al.
4,073,181 A 2/1978 Steinmann, Jr.
4,088,004 A 5/1978 Di Maio et al.
4,089,201 A 5/1978 Raptis
4,116,035 A 9/1978 Malarsky
4,208,901 A 6/1980 Elflein
4,235,090 A 11/1980 Wightman et al.
4,289,017 A 9/1981 Guidry
4,300,382 A 11/1981 Meek
4,429,562 A 2/1984 Hultquist
4,476,705 A 10/1984 Meek
4,502,317 A 3/1985 Hultquist
4,503,701 A 3/1985 Hardy
4,827,759 A 5/1989 Mattson
4,924,056 A 5/1990 Bevilacqua
4,930,335 A 6/1990 Ishihara
5,113,687 A 5/1992 Palmgren
5,203,196 A 4/1993 Jenkins
(Continued)

*Primary Examiner* — David B Jones
(74) *Attorney, Agent, or Firm* — Brett Peterson; Pate Peterson PLLC

(57) ABSTRACT

A dent removal tool for removing dents from automobile panels is provided. The tool includes a body with a handle on one end and a rest plate for contacting the body panel on the opposite end. A clamp for gripping one or more studs which have been welded to the body panel is located between the handle and the rest plate. The tool gives an automobile repair technician a high degree of mechanical advantage and control in removing dents from body panels.

19 Claims, 8 Drawing Sheets

U.S. PATENT DOCUMENTS

| | | | | |
|---|---|---|---|---|
| 6,014,885 | A | 1/2000 | Griffaton | |
| 6,489,011 | B2 | 12/2002 | Uegaki | |
| 6,539,770 | B2 | 4/2003 | Olsson | |
| 6,557,231 | B1 | 5/2003 | Uegaki | |
| 6,655,185 | B2 | 12/2003 | Uegaki | |
| 6,722,179 | B1 | 4/2004 | Ventura | |
| 6,792,790 | B2 | 9/2004 | Ritter | |
| 6,957,559 | B2 | 10/2005 | Venalainten | |
| 6,964,186 | B1 | 11/2005 | Strasser et al. | |
| 7,181,951 | B1 | 2/2007 | Schmidt | |
| 7,191,634 | B1 | 3/2007 | Borgos, III | |
| 7,958,767 | B2 * | 6/2011 | Janversan | 72/459 |
| 2002/0022119 | A1 | 2/2002 | Uegaki | |
| 2002/0022897 | A1 | 2/2002 | Uegaki | |
| 2002/0035863 | A1 | 3/2002 | Lowery | |
| 2003/0070470 | A1 | 4/2003 | Uegaki | |
| 2005/0076700 | A1 | 4/2005 | Venalainen | |

* cited by examiner

DENT REMOVAL TOOL

PRIORITY

The present application is a continuation-in-part of U.S. application Ser. No. 12/642,001, now U.S. Pat. No. 7,958, 767, filed Dec. 18, 2009, which claims the benefit of U.S. Provisional application Ser. No. 61/180,844, filed May 23, 2009, which is herein incorporated by reference in its entirety.

THE FIELD OF THE INVENTION

The present invention relates to repair of automobile bodies and the like. More specifically, the present invention relates to a dent removal tool for removing dents from a vehicle body.

BACKGROUND

Repairing damaged automobile body panels forms a great portion of the duties of auto body technicians. Auto body technicians have historically used a variety of different techniques and tools to remove dents and otherwise repair automobile body panels. If a damaged body panel is accessible from behind, a hammer and dolly may be used to shape the panel to the correct form. Various body fillers are used to finish the repair. However, there are many occasions that accessing a panel may not be possible or feasible and other repair methods are necessary.

Time is a significant concern in repairing automobiles, since the labor cost is often a significant portion of the total repair costs. Thus, technicians and repair shops are desirous for faster and easier ways to properly repair body damage. Where access to a damaged body panel is limited, technicians have made one or more holes in the area being repaired and, with the help of a hook or a slide hammer which has been screwed into the hole, they would pull the dent out. This required that the hole had to be welded which increased the repair time and could compromise the strength of the body panel being repaired. In order to avoid drilling holes in the body panel, technicians began welding studs to the repair area. The stud itself would be held and pulled by various tools such as a slide hammer in order to pull the dented area along with the tool and repair the dent. After repairing the dent, the stud was simply cut and ground off, leaving no holes in the body panel.

While many systems have been created for pulling studs to repair dents, these are often quite expensive and cumbersome to set-up and operate. These systems often require specialized tools and studs, increasing the costs of the repair and in some cases making it more difficult to use a specialized tool in combination with a more generic tool while working on the same repair. Many of the available stud pulling systems are rather large, and thus are generally not readily available at the repair site and require transport to the site and set up time. Because of the expense of the dent pulling systems, a body shop may have a limited number of these tools and technicians may not have the tools immediately available when needed. In addition, since these systems are non-standard, they require training.

Despite the drawbacks described above, the use of the welded studs remains the general practice of the industry for pulling and repairing dents. It is, however, desirable to have tools for pulling the studs which are more easily used and which are less expensive than available dent removal systems.

SUMMARY OF THE INVENTION

It is an object of the present invention to provide an improved tool for use with welded studs in removing dents from automobile bodies.

A device is provided for removing dents from sheet metal panels. The device includes a lever with a handle on the first end. At the second end of the lever, a rest plate is attached. Between the first and second ends is a set of gripping jaws that grip and hold a stud which has been welded to the damaged area of the automobile panel. Once a stud is gripped in the jaws, the operator pulls the lever outwardly from the automobile panel, thereby pulling the dented area to the pre-accident shape. The rest plate contacts the automobile panel while using the tool, and pivots to allow the lever body to pivot outwardly and pull on the stud. The grip on the stud is then released. The device may also include cutting jaws for cutting the stud after pulling the dent. The studs are cut off near the body panel and the remaining part of the stud is ground flush with the body panel surface.

The device may be used to grip a single stud, or may also be used to grip multiple studs at the same time. As such, the device may be used to correct various different types of damage in an automobile body panel.

The device allows a stud to be pulled with one hand, leaving the technician one hand free to use other tools, such as using a hammer to tap the surrounding area, as is required in many situations.

The device is advantageous over available devices for removing dents as it is quite simple and inexpensive, allowing the tool to be more widely used by automobile technicians.

These and other aspects of the present invention are realized in a dent removal tool as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1A:
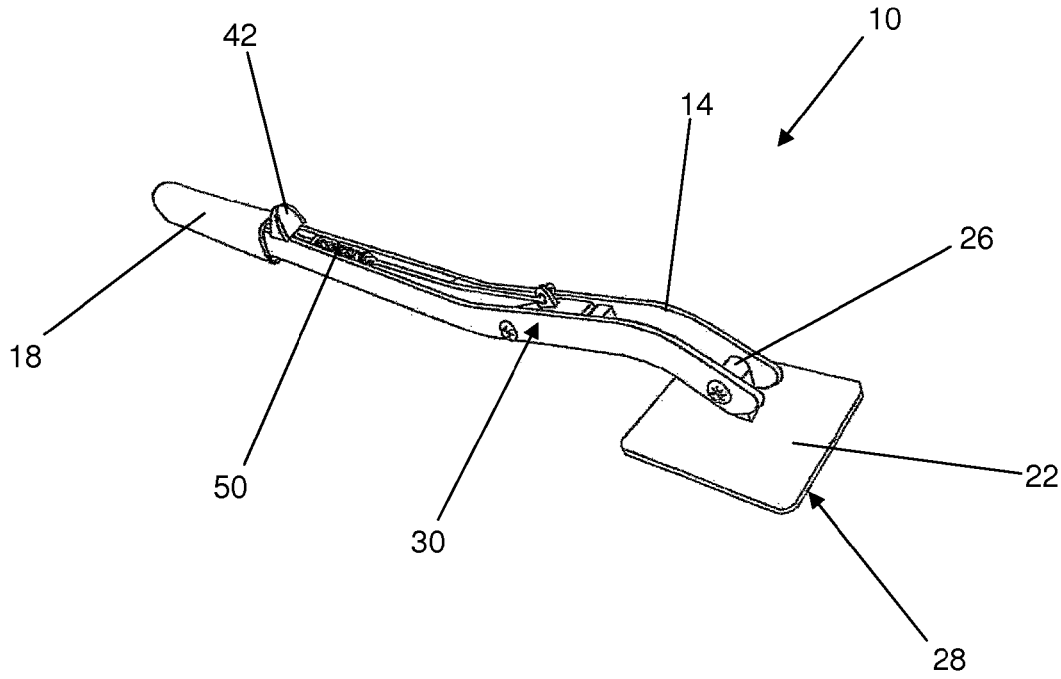
FIG. 1*a* is a perspective illustration of a dent removal tool according to the present invention.
Figure 1B:
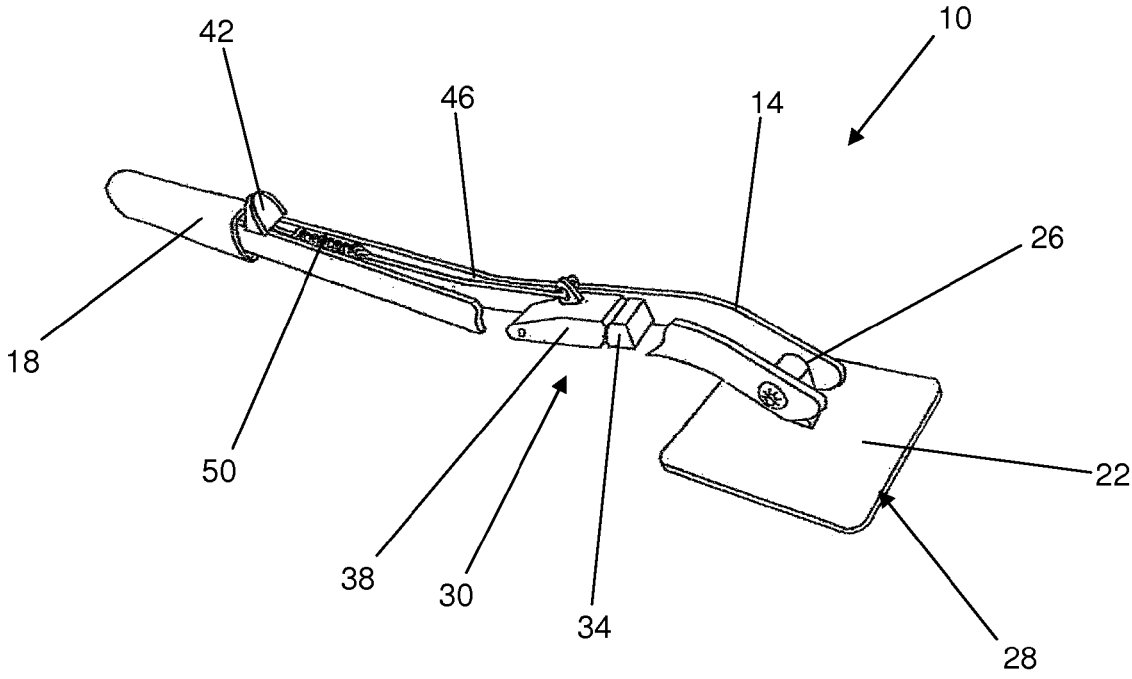
FIG. 1*b* is a partially cut-away perspective illustration of the tool of FIG. 1.
Figure 2A:
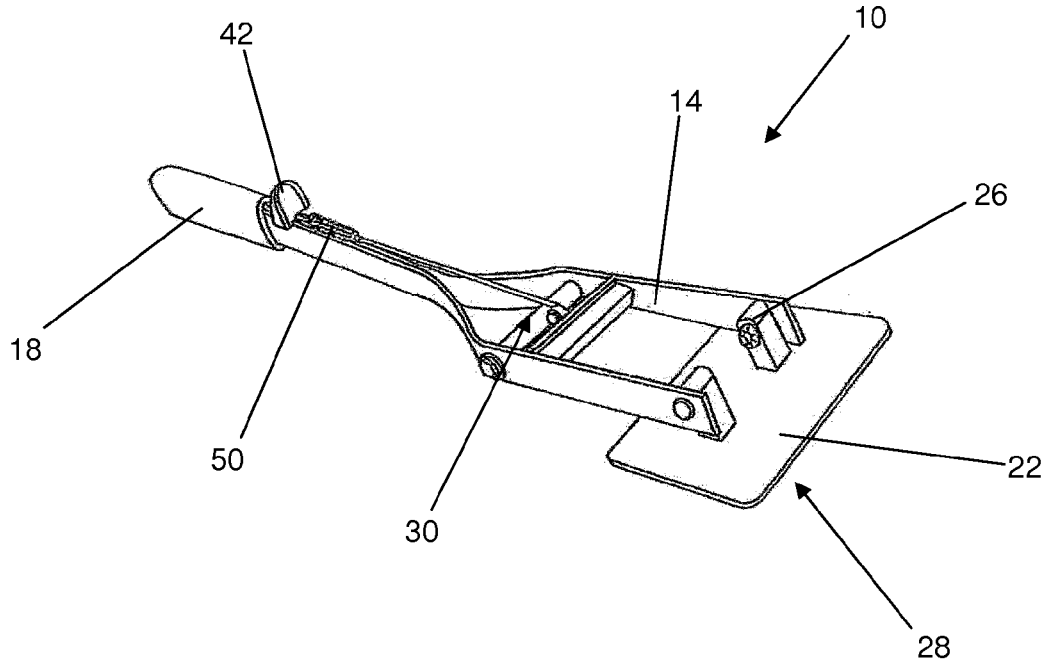
FIG. 2*a* is a perspective illustration of a wider version of the tool of FIG. 1 designed for gripping more than one stud at a time.
Figure 2B:
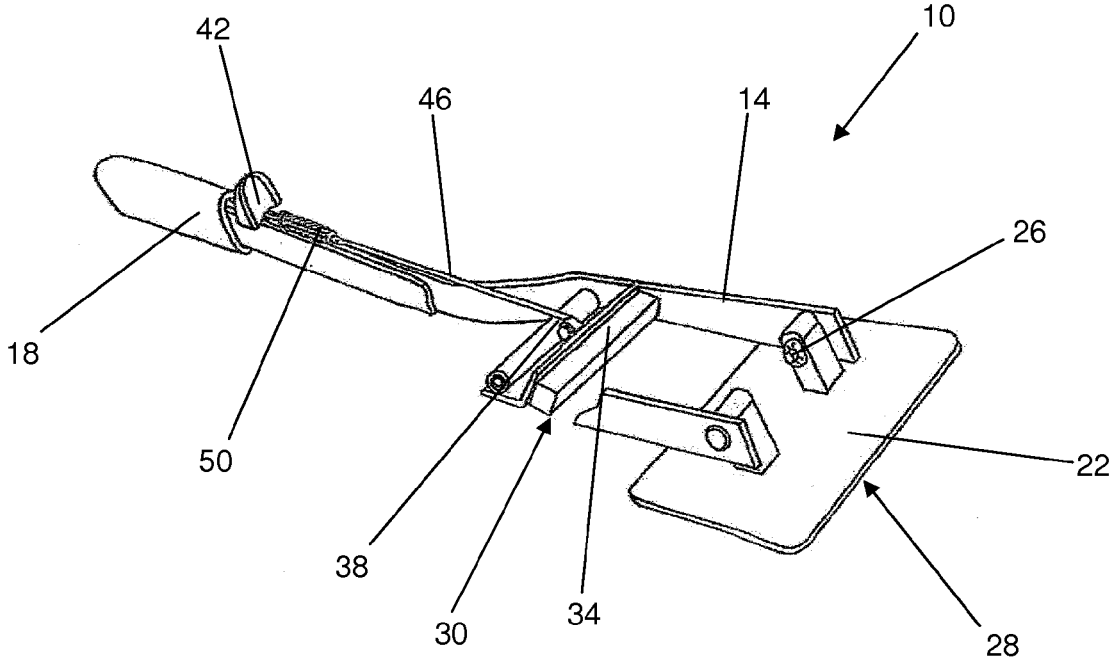
FIG. 2*b* is a partially cut-away perspective illustration of the tool of FIG. 2*a;*

Turning now to FIGS. 1*a* through 2*b*, perspective views of the device of the present invention are shown. The devices of FIGS. 1*a* and 1*b* differ from the devices of FIGS. 2*a* and 2*b* in that the device of FIGS. 2*a* and 2*b* is wider and can grip multiple studs at once. FIGS. 1*b* and 2*b* show partially cut away views of FIGS. 1*a* and 2*a*, respectively. The dent removal tool 10 has a body 14. A handle 18 is located at an end of the body 14, and a rest plate 22 is attached to the opposite end of the body 14 via pivot 26. The rest plate typically has a pad 28 attached to the lower side thereof. A clamp 30 is attached to the body 14. The clamp 30 is located between the handle 18 and the rest plate 22, at a distance away from the rest plate of between approximately fifteen and thirty percent of the length of the body 14. The clamp 30 is used to grip studs which have been welded to an automobile body.

The clamp includes a stationary jaw 34 which is rigidly attached to the body 14 and a movable jaw 38 which is pivotably attached to the body. The movable jaw 38 can pivot upwardly and away from the stationary jaw 34. The movable jaw 38 is biased to pivot towards the stationary jaw 34 so as to increase the ease and reliability of using the tool 10. As shown, the movable jaw 38 is moved away from the stationary jaw 34 when a user pulls on a thumb grip 42 located adjacent the handle 18. The thumb grip 42 is connected to the movable jaw 38 via a metal rod 46, and a spring 50 is located along the rod to bias the movable jaw 38 towards the stationary jaw 34.

Figure 3:
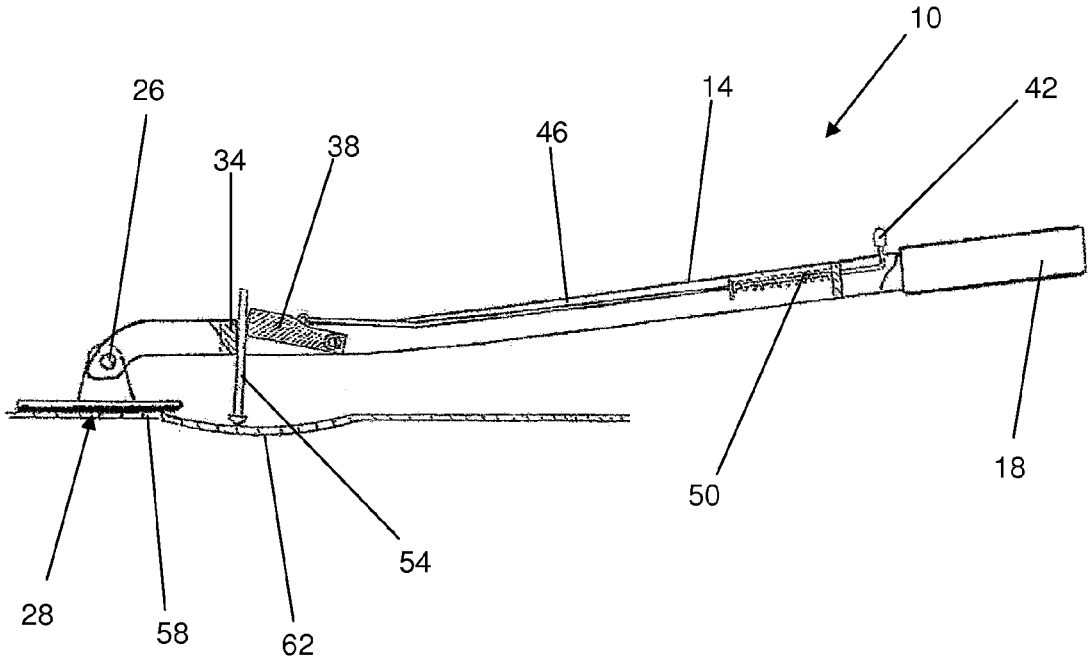
FIG. 3 illustrates the use of the tool of FIG. 1.

FIG. 3 shows a side view of the dent removal tool 10, illustrating how the tool is used. A metal stud 54 is welded to an automobile body panel 58 at a desired location in a dent 62. The dent removal tool 10 is then placed so that the rest plate 22 and pad 28 are placed against the body panel 58 and so that the stud 54 is placed between the stationary jaw 34 and the movable jaw 38. The user will typically use the thumb grip 42 to open the movable jaw 38 to receive the stud. The spring 50, located between a flange on the body 14 and a stop on the rod 46, biases the movable jaw 38 against the stationary jaw 34. Once the tool 10 is in the position shown, a user will hold the handle 18 and pull the handle away from the body panel 58 so that the stud 54 and dent 62 are also pulled outwardly. Multiple studs 54 are typically used to remove a dent. As such, the tool 10 may be made wider as shown in FIGS. 2*a* and 2*b* in order to allow the tool to grip multiple studs at the same time.

Figure 4A:
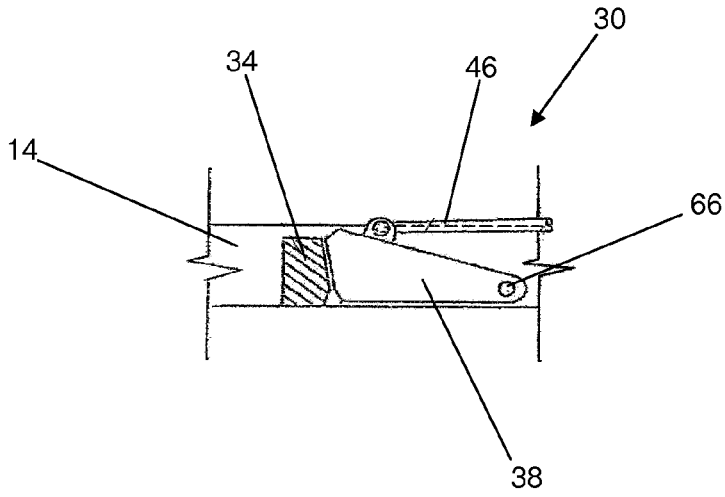
FIGS. 4*a* through 4*c* show a detailed view of the tool of FIG. 1.
Figure 4B:
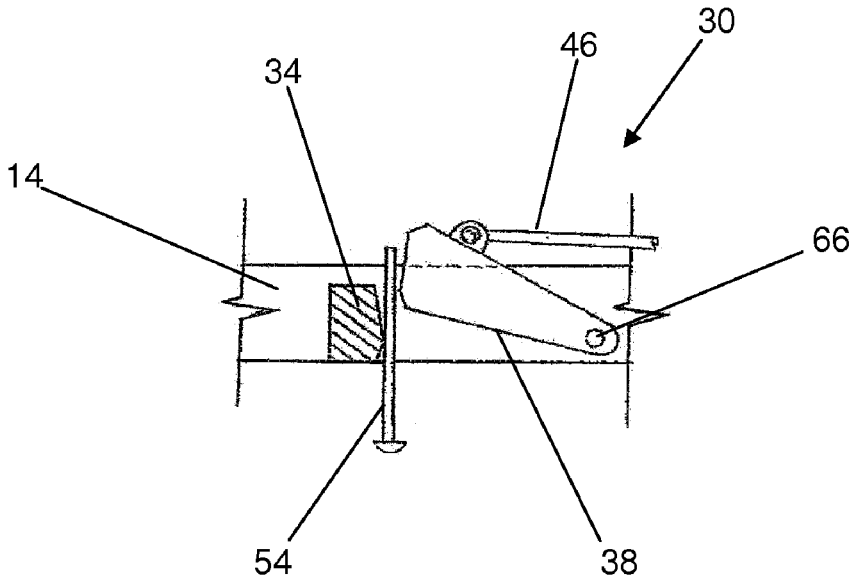
Figure 4C:
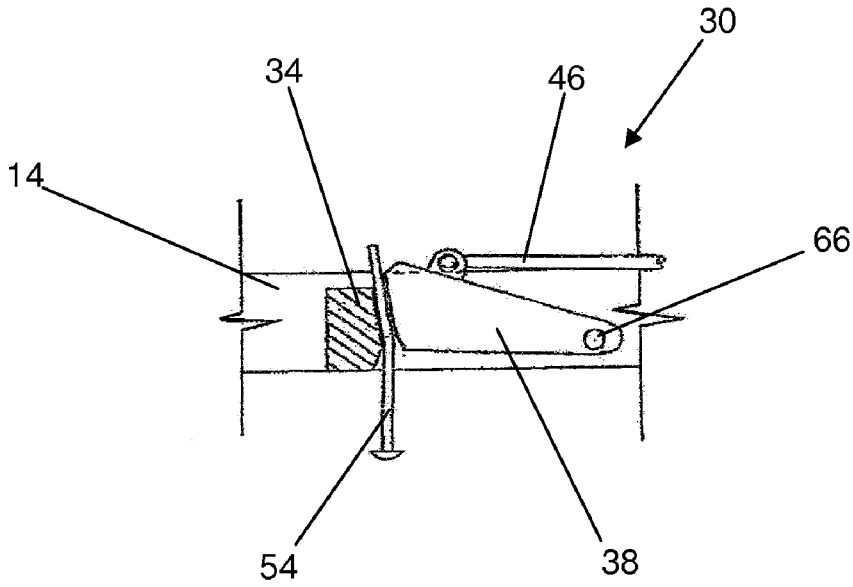
Figure 5:
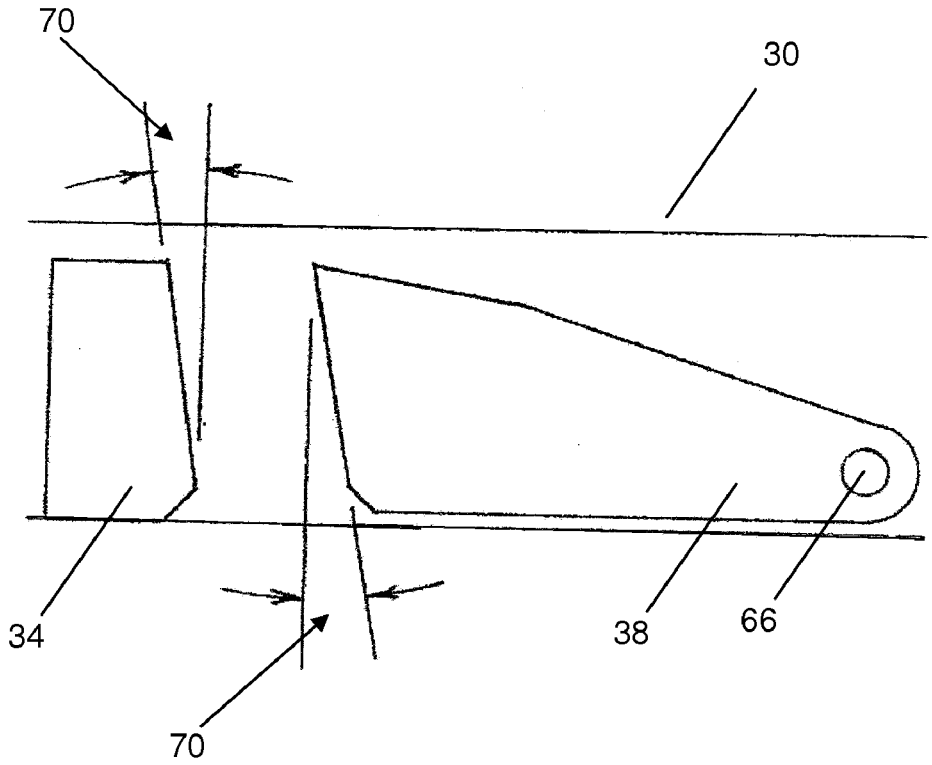
FIG. 5 shows additional details of the gripping jaws of the present tool.

Turning to FIGS. 4*a* through 4*c* and FIG. 5, additional details of the clamp 30 is shown. As shown in FIG. 5, the clamp jaws 34, 38 are angled towards the rest plate 22 as indicated at angle 70. Preferably, the jaws 34, 38 are angled forwards by between approximately five and ten degrees, and more preferably by about seven degrees. This bends the stud 62 somewhat, and helps to grip the stud. A device as shown in FIGS. 1*a* and 1*b* will often have stationary and movable jaws 34, 38 which are between about 0.5 and 1 inch wide and will grip a single stud 62 or a few closely spaced studs. A device as shown in FIGS. 2*a* and 2*b* will often have stationary and movable jaws 34, 38 which are between about 2 and 2.5 inches wide and will grip multiple studs which are spaced apart by a few inches.

FIG. 4*a* shows the movable jaw 38 in a closed position. It can be observed how the jaws are sloped towards the rest plate 22. The rod 46 is attached to the movable jaw 38, and use used to pivot the jaw away from the stationary jaw 34, as shown in FIG. 4*b*. The movable jaw is attached to the body 14 via pivot 66. Once the movable jaw 38 is pivoted away from the stationary jaw 34 a sufficient amount, the stud 54 is placed therebetween. The spring 50 urges the movable jaw 38 towards the stationary jaw 34 and maintains contact between the jaws 34, 38 and the stud 54. When the handle 18 is pulled away from the body panel to remove the dent, the stud 54 is bent against the stationary jaw 34 and the movable jaw 38 is pulled more tightly against the stud 54.

Figure 6:
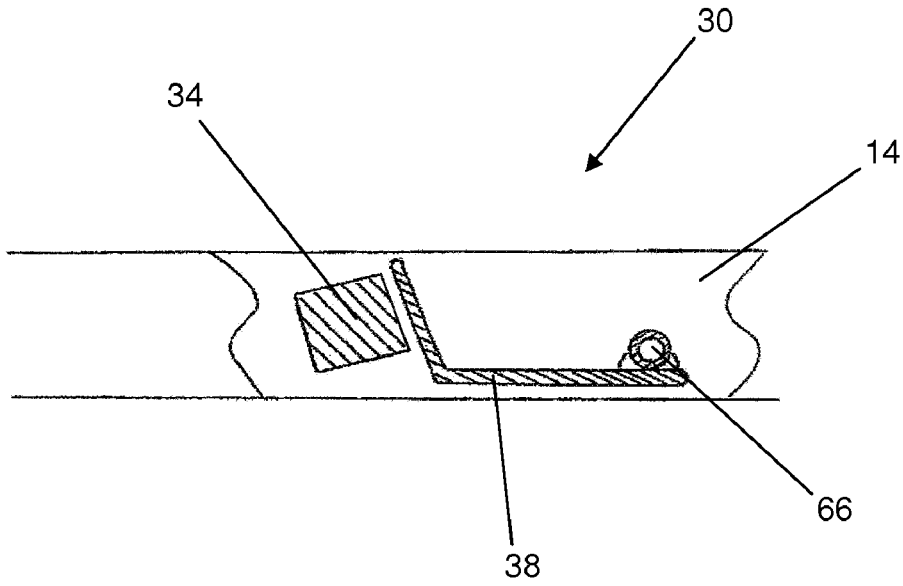
FIG. 6 shows an alternate design for the gripping jaws of the present tool.
Figure 7A:
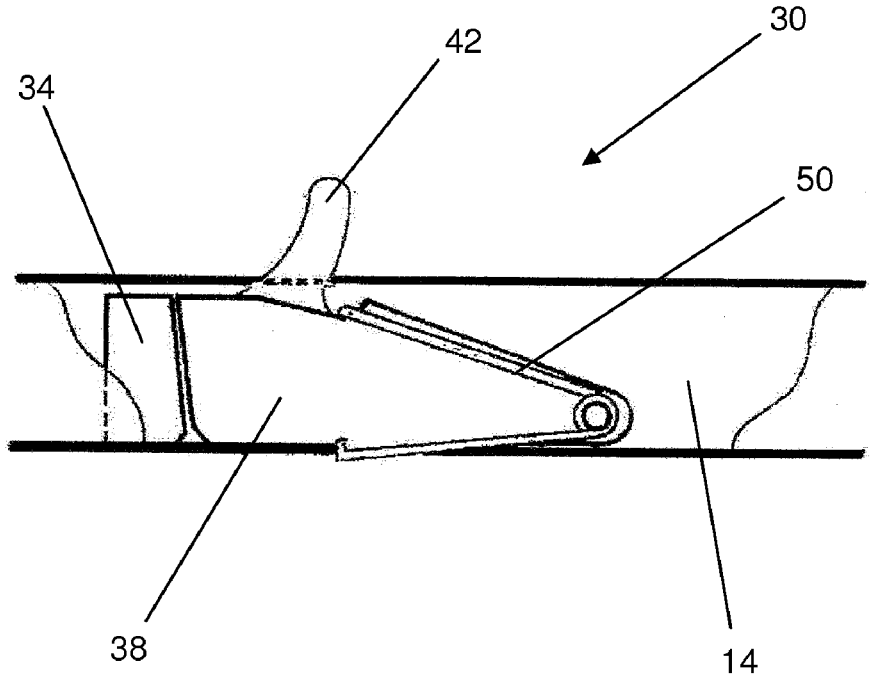
FIGS. 7*a* and 7*b* show alternate designs of the gripping jaws of the present tool.
Figure 7B:
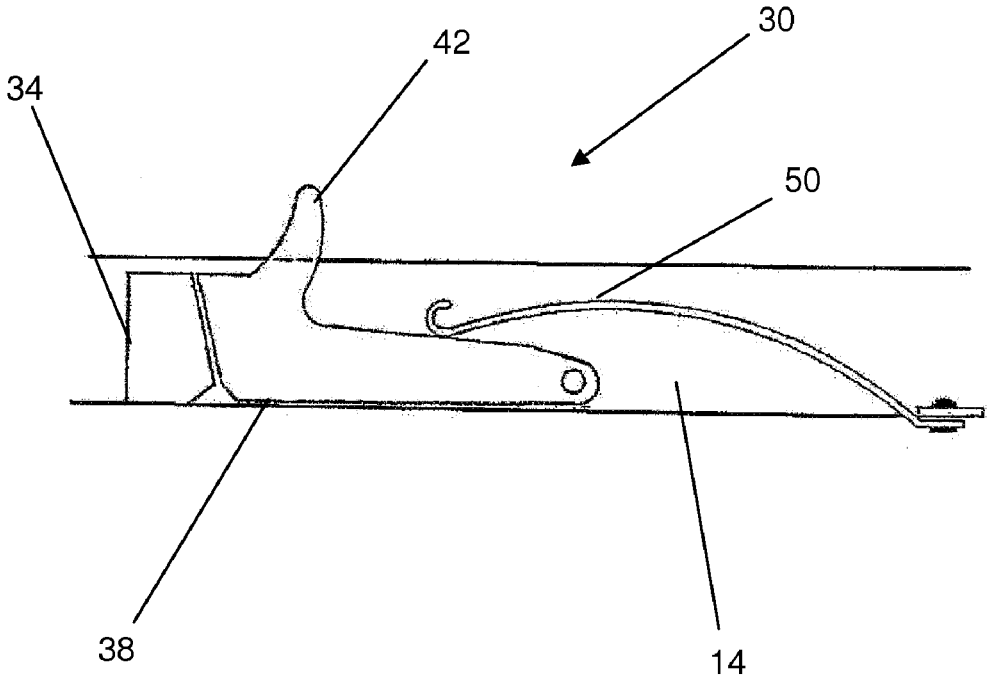

FIG. 6 shows an alternate construction of the clamp 30. It is appreciated how the shape or construction of the jaws 34, 38 can be changes somewhat while keeping the same functional geometry of the jaws 34, 38. FIGS. 7*a* and 7*b* show additional alternate constructions of the clamp 30. In these figures, the thumb grip 42 is located on the movable jaw 38. The spring 50 acts directly on the movable jaw 38, and the rod 46 is eliminated. The spring 50 may be a leaf spring as shown in FIG. 7*b* or a torsion spring as shown in FIG. 7*a*. Both of these designs retain the functionality discussed above.

While using the dent removal tool 10, the rest plate 22 sits on the surface of the body panel 58 to distribute force over the panel and prevents distortion of the panel. The construction of the body 14 and the location of the clamp 30 between the rest plate 22 and the handle 18 provides a high degree of mechanical advantage in pulling out a dent. This gives the technician the ability to pull the dent out with one hand while retaining a high degree of control and accuracy. The technician may use another tool such as a hammer while pulling the dent out as the tool 10 may be operated with one hand. This makes it easier for the technician to remove the dent.

Figure 8:
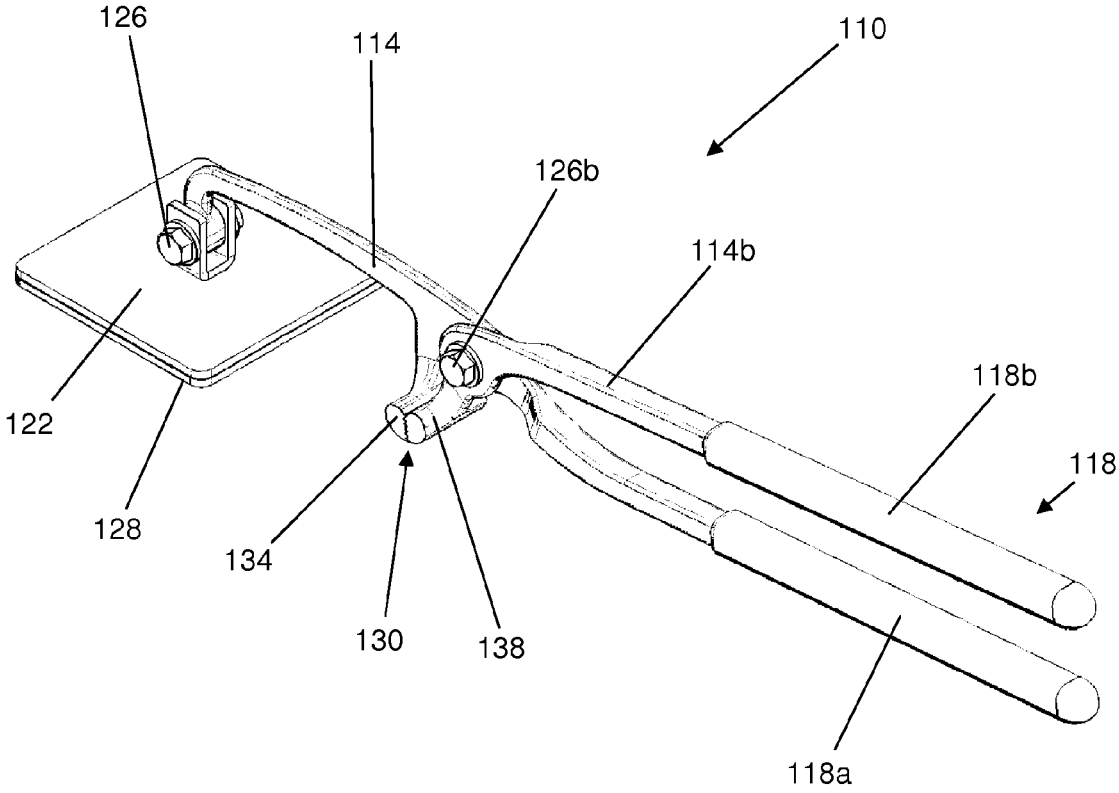
FIGS. 8 and 9 show perspective views of another dent removal tool according to the present invention.
Figure 9:
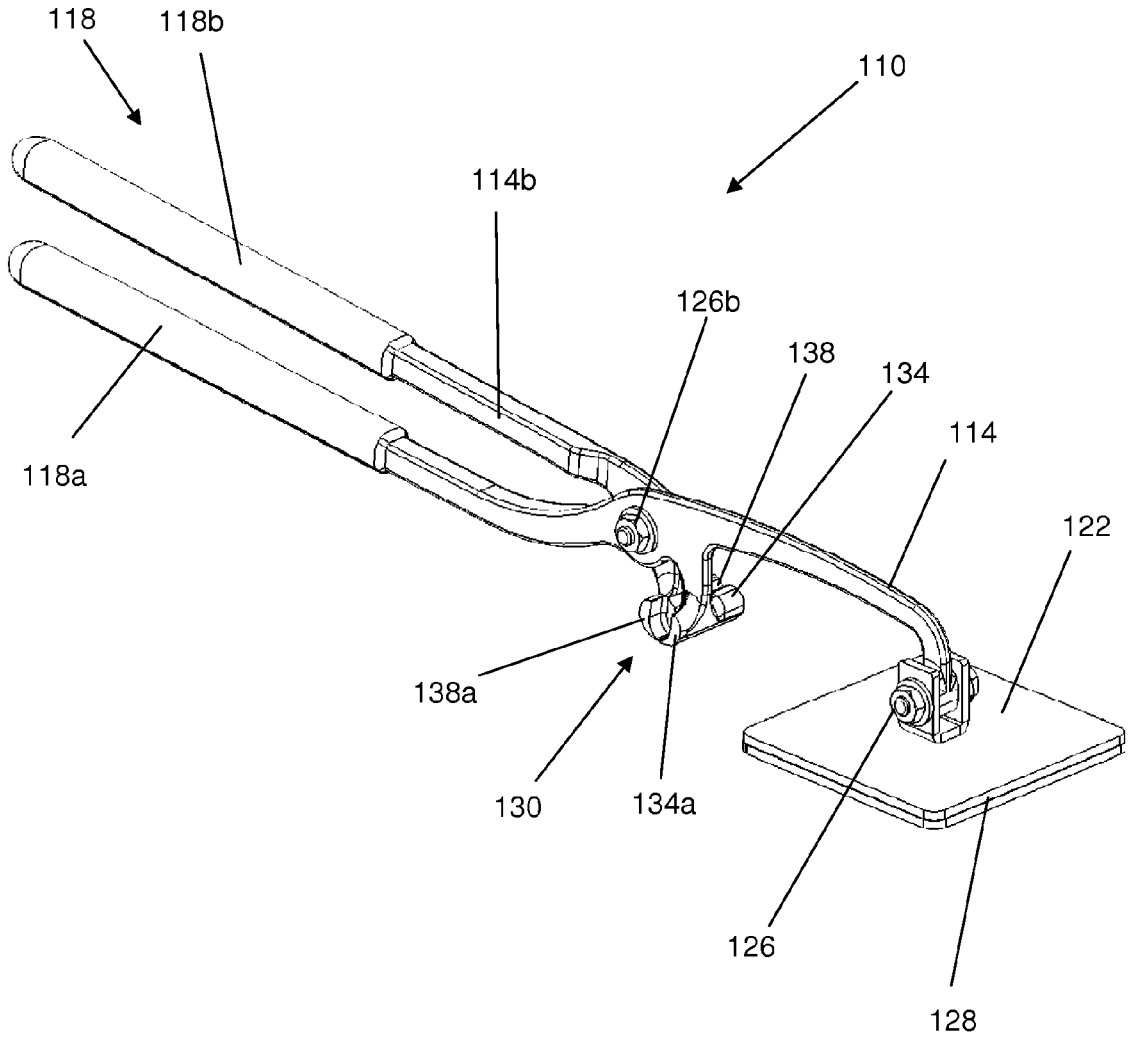

Turning now to FIGS. 8 and 9, perspective views of another dent removal tool 110 are shown. The tool 110 largely functions as described above, but is often easier to use and cheaper to manufacture. The tool 110 includes a main body 114. The back of the main body 114 has a handle 118*a* and the front of the main body 114 is pivotably connected to a rest plate 122 via a pivot bolt 126. The rest plate 122 has a pad 128 attached to the bottom thereof, and has arms of a bracket formed thereon to receive pivot bolt 126. The pad 128 contacts the automobile body panel during use of the tool 110 and A movable clamping body 114*b* is pivotably attached to the main body 114 via a pivot bolt 126*b*. The movable clamping body 114*b* includes a handle 118*b* which is disposed adjacent handle 118*a*. A clamp 130 is formed by a stationary jaw 134 and a movable jaw 138. The stationary jaw 134 is formed as part of the main body 114 and extends downwardly therefrom adjacent the pivot bolt 126*b*. The movable jaw 138 is formed as part of the movable clamping body 114*b* and pivots therewith about pivot bolt 126*b*.

In order to use the tool 110, a user would weld studs to a dented portion of a body panel as shown in the previous figures. The studs are then gripped in the clamp 130, placing the rest plate 122 against the body panel, and the user pulls on the handle 118 to pull out the dented portion of the body panel. The handle 118 and clamp 130 are formed similar to a set of pliers, allowing a user squeeze handle portions 118*a* and 118*b* together to grip the stud. The stationary jaw 134 and movable jaw 138 are wide enough to grip several adjacent studs if necessary. Typically, the stationary and movable jaws may be between 1 and 2 inches wide.

Turning to FIG. 9. the opposite side of the tool 110 is shown. The stationary jaw 134 and movable jaw 138 are formed with cutting edges 134*a* and 138*a*, respectively, on one side of the clamp 130. The cutting edges 134*a*, 138*a* allow a user to cut the studs off after use. A user may grip one or more studs in the clamping side of the clamping jaws 134, 138, pull out a dented portion of a body panel as desired, and then cut the studs off without requiring the use of a different cutting tool. In some cases, studs will be removed from a body panel in order to place other studs in a different location. The tool 110 allows a user to both pull and remove studs with a single tool. The tool 110 is also advantageous as it has a relatively narrow clamp 130 which is able to grip a stud fairly easily even when other studs are attached to the body panel at nearby locations.

The tool 110 is advantageous for several reasons. The tool 110 is inexpensive to manufacture. The rest plate 122 may be stamped from plate steel with brackets being bent upwards in the middle to receive pivot bolt 126. The main body 114 and movable clamping body 114*b* can easily be cast and formed in the same manner that pliers and other similar hand tools are made. The tool 110 is also advantageous as it is a convenient and easy to use design. Because the studs are gripped by squeezing the handle parts 118*a*, 118*b* together in the same manner that pliers are used, it is easy and natural for repair technicians to use the tool. The tool allows a technician to securely grip a stud and pull out a dented body panel with a single hand, leaving the other hand free to use other tools such as a hammer. This allows the technician to work quickly and efficiently. The clamp 130 is able to grip one or more studs quickly and easily without requiring a precise spacing or layout as is required with other available stud pulling systems. The tool 110 provides a dent removal system which is inexpensive and easy to use.

There is thus disclosed an improved automotive dent removal tool. It will be appreciated that numerous changes may be made to the present invention without departing from the scope of the claims.

What is claimed is:

1. A tool for removing dents from body panels comprising:
an elongate body;
a handle located at a first end of the body;
a rest plate pivotably attached to a second end of the body; and
a clamp attached to the body between the rest plate and the handle, the clamp being configured for gripping a stud which has been attached to a body panel and which extends from the body panel, wherein the clamp comprises a stationary jaw and a movable jaw which is pivotably mounted to the body, and wherein at least one of the stationary jaw and movable jaw comprises a cutting edge for cutting a stud.

2. The tool of claim 1, wherein the clamp is located along the body at a distance from the rest plate pivot of between 15 and 30 percent of the length of the body.

3. The tool of claim 1, wherein the tool comprises a movable body member pivotably attached to the elongate body, the movable body member extending along the elongate body to form a portion of the handle and having the movable jaw attached thereto.

4. The tool of claim 1, wherein the clamp extends laterally to grip multiple studs at the same time.

5. The tool of claim 4, wherein a first portion of the clamp comprises gripping jaws configured to grip a stud and wherein a second portion of the clamp comprises cutting jaws configured to cut a stud.

6. The tool of claim 1, wherein the stationary and movable jaws are between about 0.5 and 2 inches wide.

7. A tool for removing dents from a body panel comprising:
an elongate body having a first end and a second end;
a first handle portion located on the first end of the body;
a rest plate pivotably attached to the second end of the body;
a stationary clamp jaw attached to the body between the rest plate and the handle;
a movable body member pivotably attached to the elongate body, the movable body member having a movable clamp jaw disposed adjacent the stationary clamp jaw and having a second handle portion disposed adjacent the first handle portion.

8. The tool of claim 7 further comprising a pad located on the bottom side of the rest plate.

9. The tool of claim 7, wherein the stationary clamp jaw and the movable clamp jaw extend laterally across the body and are between about 0.5 and 2.5 inches wide.

10. The tool of claim 7, wherein the stationary clamp jaw and the movable clamp jaw extend laterally across the body and are of sufficient width to permit the gripping of multiple autobody studs simultaneously.

11. The tool of claim 7, wherein the stationary clamp jaw and the movable clamp jaw have a clamping portion for gripping metal studs and a cutting portion for cutting metal studs.

12. A tool for removing dents from a metal panel comprising:
a first body member having first end and a second end, the second end forming a first handle portion;
a pivot disposed between the first end and second end of the first body member;
a second body member pivotably attached to the first body member via the pivot, the second body member extending towards the second end of the first body member and forming a second handle portion;
a first clamp jaw attached to the first body member;
a second clamp jaw attached to the second body member; and
a rest plate pivotably attached to the first end of the first body member.

13. The tool of claim 12, wherein the pivot is disposed approximately one third of the distance between the first end and the second end of the first body member.

14. The tool of claim 12, wherein the first and second clamp jaws are selectively moved together by movement of the first and second handle portions.

15. The tool of claim 12, wherein at least one of the first clamp jaw and the second clamp jaw comprises a cutting edge for cutting metal studs.

16. A tool for removing dents from body panels comprising:
an elongate body, the elongate body having a first end comprising a handle and a second end disposable adjacent a body panel to press against the body panel;
a clamp attached to the elongate body between the first end and the second end, the clamp being movable to grip a stud which has been attached to the body panel; and
wherein the clamp comprises a first jaw and a second jaw selectively movable together to grip a stud, and wherein at least one of the first jaw and the second jaw comprises a cutting edge for cutting the stud.

17. The tool of claim 16, wherein the first jaw is stationary relative to the elongate body, and wherein the second jaw is formed as part of a second body member, the second body member being pivotably attached to the elongate body and defining a handle portion adjacent the first end of the elongate body.

18. A tool for removing dents from a body panel comprising:

an elongate body portion defining a first end and a second end, the first end of the elongate body portion defining a first handle portion, the second end of the elongate body portion being disposable adjacent a body panel to press against a body panel;

a first clamp jaw attached to the elongate body portion between the first end and the second end;

a movable body member pivotably attached to the elongate body portion, the movable body member having a first end extending adjacent the first end of the elongate body portion and defining a second handle portion, the movable body member also having a second clamp jaw movable towards the first clamp jaw to clamp a stud which is attached to the body panel.

19. The tool of claim 18, wherein at least one of the first clamp jaw and the second clamp jaw comprises a cutting edge for cutting metal studs.

* * * * *